US007699902B2

(12) United States Patent
Ohsawa et al.

(10) Patent No.: US 7,699,902 B2
(45) Date of Patent: Apr. 20, 2010

(54) REFUSE-TRAPPING COVER FOR USE IN PORTABLE WORKING MACHINE

(75) Inventors: Hisato Ohsawa, Tokyo (JP); Kazuhiro Yoneyama, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 435 days.

(21) Appl. No.: 11/803,958

(22) Filed: May 16, 2007

(65) Prior Publication Data

US 2007/0266966 A1 Nov. 22, 2007

(30) Foreign Application Priority Data

May 18, 2006 (JP) ..... 2006-138982

(51) Int. Cl.
*F01P 1/02* (2006.01)
*F02B 77/00* (2006.01)

(52) U.S. Cl. ..... 55/385.1; 55/385.3; 123/41.7; 123/198 E; 30/59; 30/60; 30/65; 30/70; 30/74.1; 30/77; 30/370; 30/390

(58) Field of Classification Search ..... 55/385.1, 55/385.3; 123/198 E, 41.7; 30/59, 60, 65, 30/70, 74.1, 77, 370, 390
See application file for complete search history.

(56) References Cited

U.S. PATENT DOCUMENTS 3,994,067 A * 11/1976 Hazzard et al. ..... 30/383
4,370,855 A * 2/1983 Tuggle ..... 60/317
4,626,266 A * 12/1986 Sasaki ..... 55/385.1
5,168,837 A * 12/1992 Scholz ..... 123/41.7
5,687,689 A * 11/1997 Santos ..... 123/198 E
6,068,675 A * 5/2000 Tsuda et al. ..... 55/385.3
6,125,501 A * 10/2000 Yip ..... 15/344
6,295,953 B1 * 10/2001 Ohsawa et al. ..... 123/41.7
7,311,067 B2 * 12/2007 Riehmann ..... 123/41.7
2006/0027192 A1 * 2/2006 Tsukada et al. ..... 123/41.7
2008/0104936 A1 * 5/2008 Kellermann ..... 55/357

FOREIGN PATENT DOCUMENTS

DE 2806107 8/1979
JP 55075527 6/1980

OTHER PUBLICATIONS

Office Action for DE 102007024213.3, May 29, 2008.

* cited by examiner

*Primary Examiner*—Duane Smith
*Assistant Examiner*—Minh-Chau T Pham
(74) *Attorney, Agent, or Firm*—Baker Botts LLP

(57) ABSTRACT

There is provided a refuse-trapping cover for a portable working machine, which is capable of reducing the deterioration of the engine-cooling performance of the cooling fan that may be caused by the fibrous sawdust of a palm tree. The refuse-trapping cover includes a frame (40) having a plurality of open windows (40*a*-40*j*) and attached to the outer casing (20) of a chain saw (1) to thereby cover the air inlet slits (22), and a mesh member (50) integrally fixed to the frame (40) to thereby cover open windows (40*a*-40*j*). The frame (40) is constructed to have predetermined dimension and configuration, and the mesh member (50) is fixed to a predetermined location of the frame (40) to thereby provide a sufficient space (S) between the mesh member (50) and the outer casing (20) to avoid the mesh member (50) from being adsorbed onto the outer casing (20).

16 Claims, 4 Drawing Sheets

REFUSE-TRAPPING COVER FOR USE IN PORTABLE WORKING MACHINE

FIELD OF THE INVENTION

The present invention relates to a refuse-trapping cover which is useful in a portable working machine such as a chain saw and is designed to trap refuse such as sawdust of palm trees, wherein the portable working machine typically includes a main housing incorporating therein a cooling fan for an internal combustion engine, and an outer casing having a large number of air inlet slits and disposed to cover the cooling fan.

BACKGROUND INFORMATION

As depicted in FIG. 5, a chain saw 1 representing one example of the portable working machine is designed such that a guide bar 11 and a saw chain 12 slidably hanged around the guide bar 11 are disposed, as a working member, on the right side of the fore portion of main housing 2. The saw chain 12 is designed to be driven by an internal combustion engine (such as an small air-cooled two-stroke gasoline engine) which is disposed inside the main housing 2.

A rear-handle 14 including a throttle trigger 15 and is attached to a rear portion of the main housing 2. A front-handle 17 having a nearly C-shaped or loop-like configuration is attached to an outer periphery of a central portion of the main housing 2 in such a manner that the front-handle 17 is extended from the left side of the main housing 2. Further, a hand guard 19 is attached to an upper fore-portion of the main housing 2.

On the left side of the main housing 2, there are a cooling fan for cooling the internal combustion engine and a recoil starter (only a starter handle 18 is shown in FIG. 5). An outer casing (fan casing) 20 with a large number of air inlet slits 22 is attached to the left side of the main housing 2 so as to cover the cooling fan as well as the starter.

This chain saw 1 constructed as described above is suitable for cutting and pruning trees and branches. However, as shown in U.S. Pat. No. 5,687,689, this chain saw 1 may also be used in the pruning work of a palm tree.

However, the following problems can occur if the chain saw 1 constructed as described above is to be employed in the pruning work of a palm tree. Namely, not only powdery sawdust but also fibrous sawdust such as cloth scrap-like or waste thread-like sawdust is generated in the pruning work of a palm tree. As a result, this fibrous sawdust gets sucked into the main housing 2 through the air inlet slits 22 of the outer casing 20, thereby clogging the space between the cylinder cover and the cooling fan. As a result of this clogging, the flow of the cooling air is obstructed which greatly deteriorates the performance of cooling fan (air volume) to cool the engine. In order to remove the fibrous sawdust trapped in the space between the cylinder cover and the cooling fan, the outer casing, cylinder cover, and other parts must generally be removed.

With a view to overcome these problems, U.S. Pat. No. 5,687,689 proposes the employment of a mesh member which is designed to be attached to the outer casing so as to cover the air inlet slits thereof.

The idea to directly attach a mesh member to the surface of the outer casing as described in the aforementioned U.S. Patent, however, still has the following problems: (1) the mesh member can be clogged with fibrous sawdust that has been trapped by the mesh member, thereby making it difficult to secure a sufficient performance (air volume) to cool the engine; (2) due to external factors such as the collision of the mesh member with branches of tree, the mesh member may be easily torn or damaged; and (3) it takes time in mounting or exchanging the mesh member.

The present invention is intended to overcome the aforementioned drawbacks, and therefore an object of the present invention is to provide a refuse-trapping cover for a portable working machine, which is capable of reducing the deterioration of the engine-cooling performance of the cooling fan that may be caused by the fibrous sawdust of a palm tree.

BRIEF SUMMARY OF THE INVENTION

With a view to realize the aforementioned object, the present invention provides a refuse-trapping cover which is useful in a portable working machine, wherein the portable working machine typically includes a main housing incorporating therein a cooling fan for an internal combustion engine, and an outer casing having a large number of air inlet slits and disposed to cover the cooling fan; the refuse-trapping cover being featured in that it includes a frame having a plurality of open windows and attached to the outer casing to thereby cover the air inlet slits, and a mesh member integrally fixed to the frame to thereby cover said plurality of open windows.

In an exemplary embodiment, the frame is designed to have a predetermined dimension and configuration, and the mesh member is fixed to a predetermined location of the frame to thereby provide a sufficient space between the mesh member and the outer casing to avoid the mesh member from being adsorbed onto the outer casing.

In another exemplary embodiment, the frame is partially or entirely located outside the mesh member.

In yet another exemplary embodiment, the frame is made of a resilient elastic synthetic resin.

In an exemplary embodiment, the mesh member is fixed to the frame by means of insert molding or integral molding, rendering the mesh member sandwiched between a front surface of the frame and a rear surface of the frame.

In another exemplary embodiment, the mesh member is made of a synthetic resin such as nylon or a metallic material.

A grid portion of the mesh member is constituted by openings each 0.5 $mm^2$-3.0 $mm^2$ in size, thereby enabling powdery sawdust to pass therethrough while enabling fibrous sawdust to be entrapped therein.

In a further embodiment, the refuse-trapping cover is removably attached to the outer casing.

In a further embodiment, the frame is provided with a mounting hook which is designed to be engaged with a peripheral edge portion of the air inlet slits.

According to an aspect of the refuse-trapping cover for a portable working machine which is proposed by the present invention, since the mesh member is disposed to cover the air inlet slits of the outer casing, it is possible, by means of the mesh member, to entrap the fibrous sawdust generated during the pruning work of a palm tree before the fibrous sawdust gets sucked into the main housing. As a result, the present invention reduces the possibility that the fibrous sawdust enters into a space between the cylinder cover and the cooling fan to clog the space, and hence it is now possible to secure a desired engine-cooling performance (air volume).

Further, since the dimension and configuration of the frame are designed so as to provide a sufficient space between the mesh member and the outer casing in order to avoid the mesh member from being adsorbed onto the outer casing, it is now possible to increase an effective cooling air-sucking area as compared with the conventional structure where the mesh member is directly adhered onto the surface of the outer casing. Moreover, since this increment of effective cooling air-sucking area cannot be offset by the adsorption of the mesh member onto the outer casing that may be caused by the negative pressure resulting from the operation of the cooling fan, it is possible to secure a sufficient engine-cooling performance (air volume) even if the mesh member is partially clogged by the fibrous sawdust that has been trapped by the mesh member.

Further, since the frame is partially or entirely disposed on the outside (front surface side) of the mesh member, it is possible to minimize the possibilities of the mesh member being damaged by an external factor such as the collision thereof with branches of tree.

Furthermore, since the mesh member can be formed integral with the frame, it is possible to secure a additional structural strength. Additionally, since the refuse-trapping cover is removably attached, through a mounting hook and/or other suitable means to the outer casing, the removal of the refuse-trapping cover from the outer casing on the occasion of cleaning the mesh member or on the occasion of disuse of the refuse-trapping cover can be facilitated. Likewise, the attachment of the refuse-trapping cover to the outer casing can be more easily performed, thus enhancing the convenience in the employment thereof.

DETAILED DESCRIPTION OF THE INVENTION

Next, one embodiment of the refuse-trapping cover which is useful in a portable working machine according to the present invention will be explained with reference to the drawings.

Figure 1:
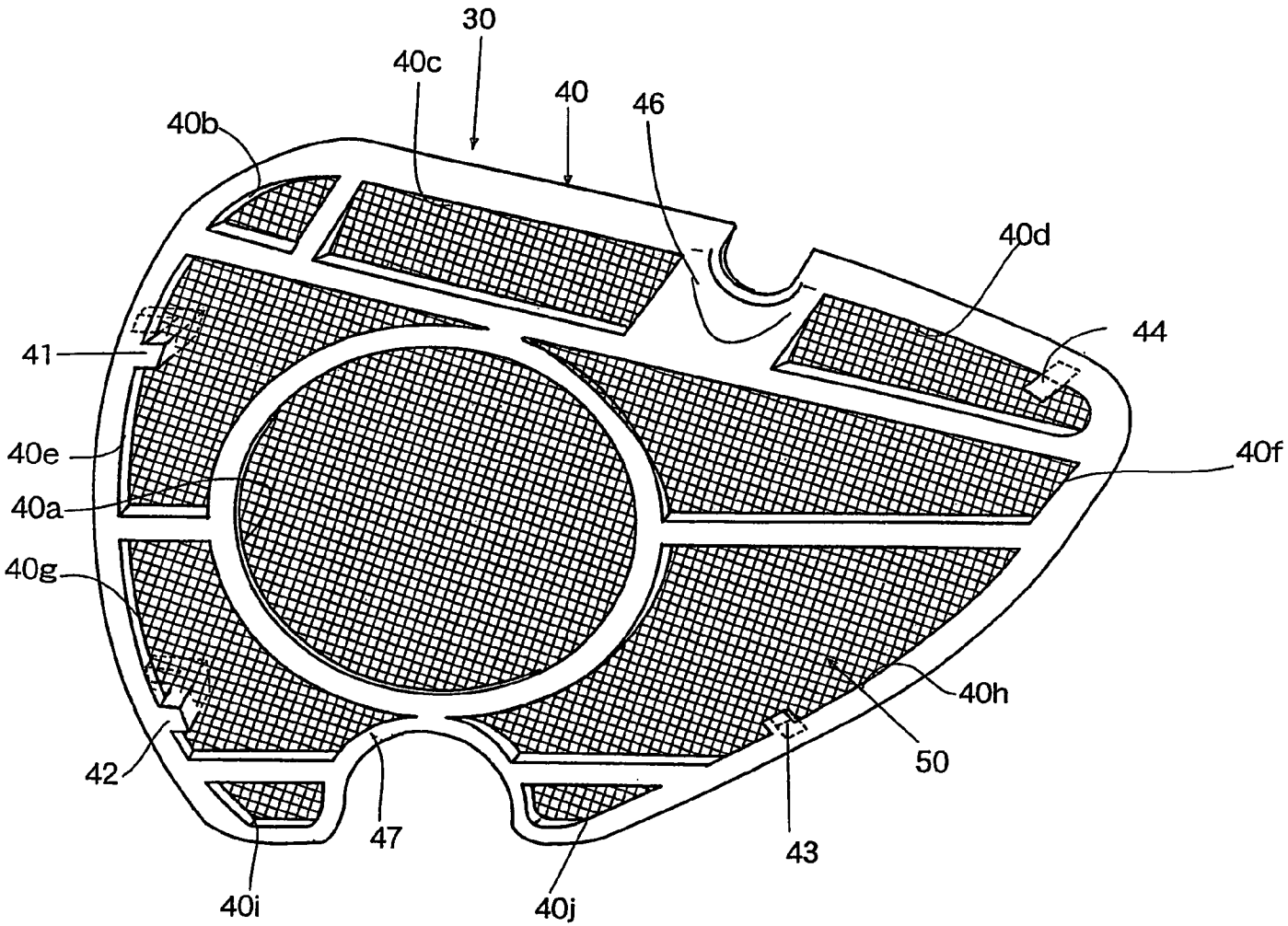
FIG. 1 is a perspective view illustrating one example of the refuse-trapping cover for a portable working machine according to the present invention.

FIG. 1 is a perspective view illustrating one example of the refuse-trapping cover for a portable working machine according to the present invention.

Figure 2:
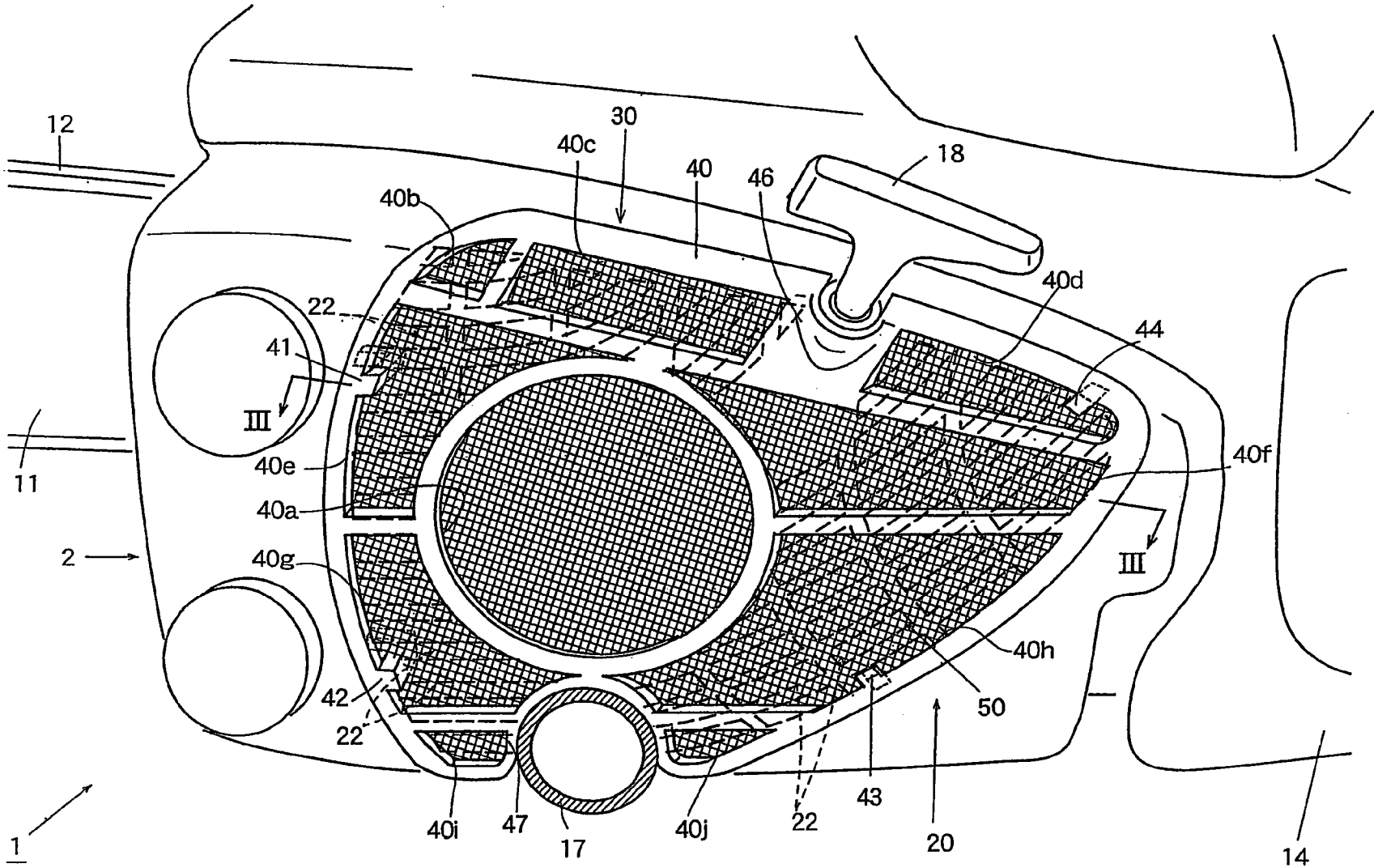
FIG. 2 is a perspective view illustrating a state wherein the refuse-trapping cover shown in FIG. 1 is mounted on a chain saw.
Figure 5:
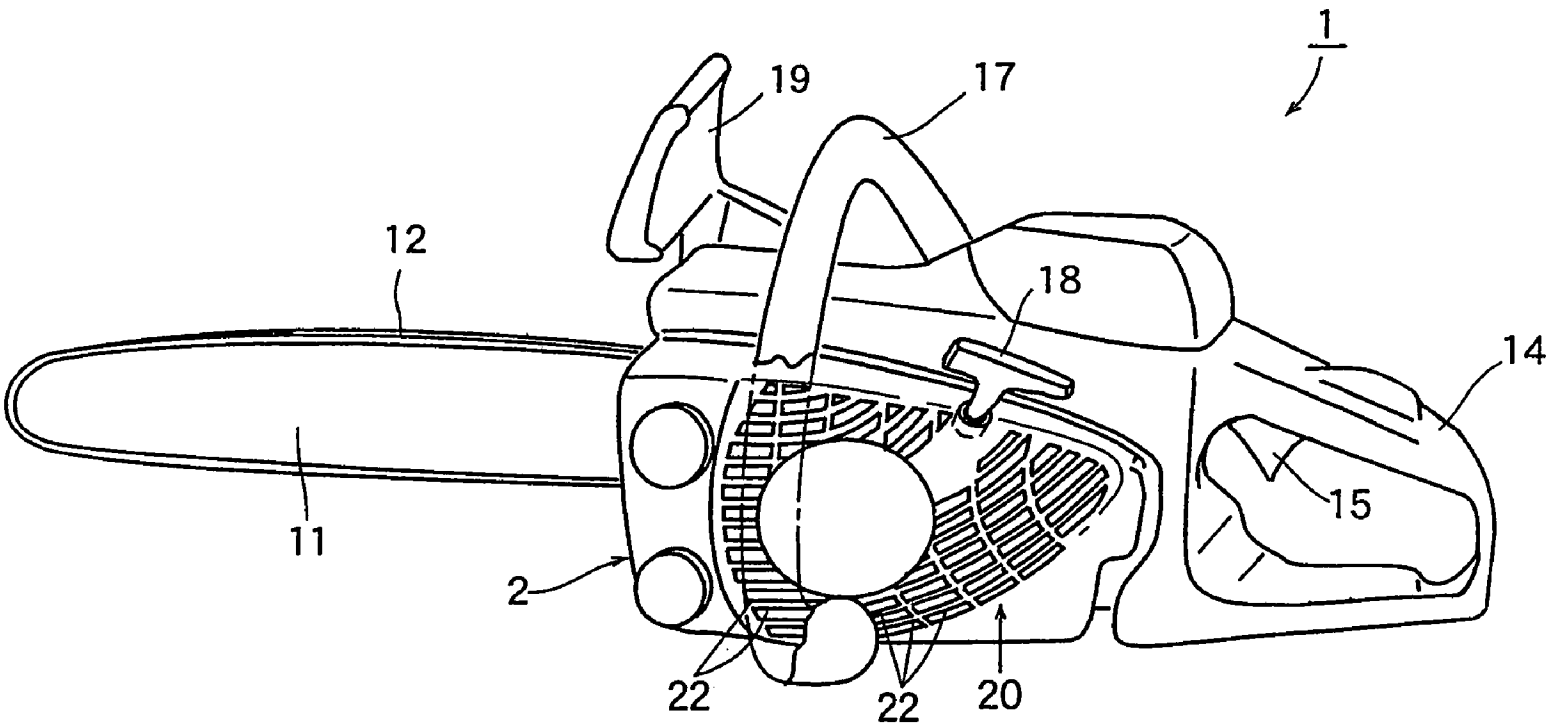
FIG. 5 is a perspective view showing a chain saw representing one example of a portable working machine, to which the refuse-trapping cover of the present invention can be applied.

The refuse-trapping cover 30 according to this example shown in FIG. 1 is designed to be used in a chain saw 1 which is illustrated in FIG. 5 described above. As shown in FIG. 2, this refuse-trapping cover 30 includes a dish-like frame 40 (see also FIG. 3) attached to an outer casing 20 of the chain saw 1 so as to cover all of the air inlet slits 22, and a mesh member 50 made of nylon.

The frame 40 is made of a resilient elastic synthetic resin and provided with a plurality of open windows 40*a*, 40*b*, 40*c*, 40*d*, 40*e*, 40*f*, 40*g*, 40*h*, 40*i* and 40*j* having various configurations such as a circular, triangular or rectangular configuration. The frame 40 is also provided with handle-contacting portions 46 and 47. Further, the frame 40 is provided, at appropriate intervals, with L-shaped mounting hooks 41, 42, 43 and 44 (only the mounting hook 41 is clearly shown as a typical example in FIG. 3), which are designed to be engaged with a periphery edge portion of the air inlet slits 22.

Figure 3:
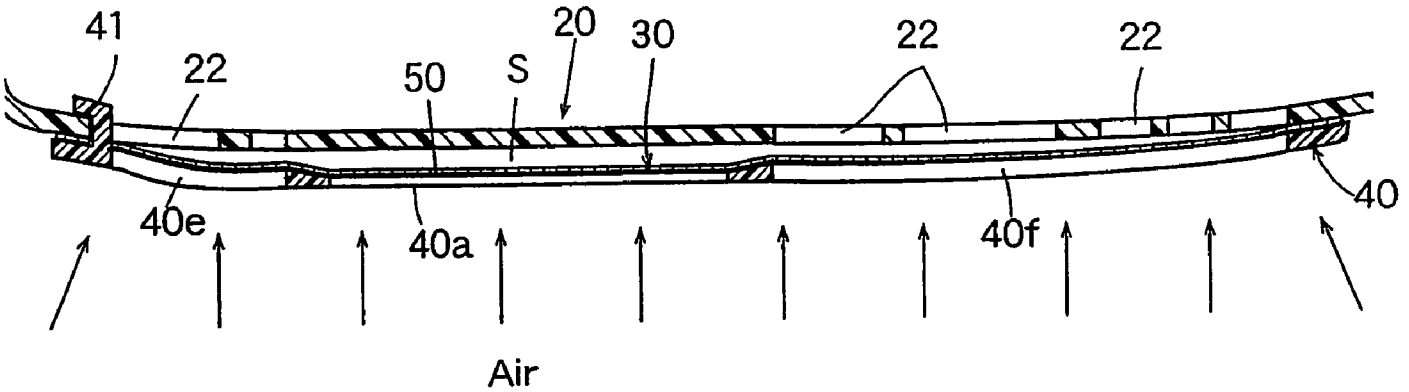
FIG. 3 is a cross-sectional view taken along the line III-III of FIG. 2.

As shown in FIG. 3 in addition to FIGS. 1 and 2, the mesh member 50 is integrally fixed to the rear surface of the frame 40 by making use of an adhesive for example so as to cover all of the open windows 40*a*-40*j*. Accordingly, the frame 40 in this embodiment is disposed on the outside (front surface side) of the mesh member 50.

Further, a grid portion of the mesh member 50 is constituted by openings each 2.0 $mm^2$ in size, thereby enabling powdery sawdust to pass therethrough while enabling fibrous sawdust to be entrapped therein.

As shown in FIG. 3, in this embodiment, the dimension and configuration (curvature) of the frame 40 are set such that a space "S" having a predetermined depth can be secured between the mesh member 50 and the outer casing 20.

Figure 4:
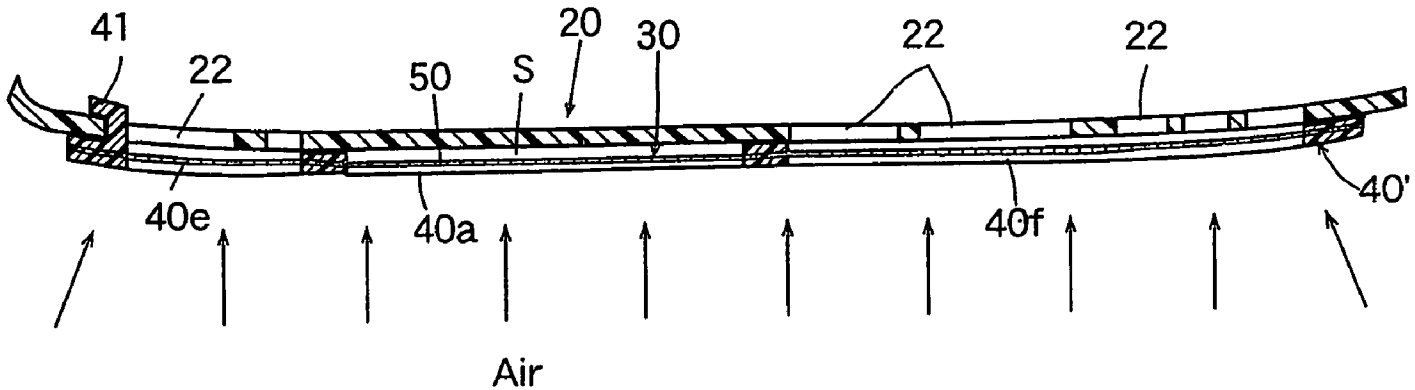
FIG. 4 is a cross-sectional view of another example of the refuse-trapping cover according to the present invention, the cross-sectional view corresponding to that taken along the line III-III of FIG. 2.

The aforementioned space "S" having a predetermined depth between the mesh member 50 and the outer casing 20 may be formed, other than the aforementioned method (FIG. 3), in such a manner that, when the frame is molded, the mesh member 50 is insert-molded or integrally molded so as to permit the mesh member 50 to be sandwiched between the front surface and the rear surface of the frame 40' as shown in FIG. 4. In this case also, the frame 40' is partially disposed on the outside (front surface side) of the mesh member 50.

According to the refuse-trapping cover 30 for a portable working machine constructed as described in the foregoing embodiment, since the mesh member 50 is disposed to cover the air inlet slits 22 of the outer casing 20, it is possible, by means of the mesh member 50, to entrap the fibrous sawdust generated during the pruning work of a palm tree before the fibrous sawdust is sucked into the main housing 2. As a result, it is possible to reliably avoid such a situation that the fibrous sawdust enters into a space between the cylinder cover and the cooling fan to clog the space, and hence it is now possible to secure a desired engine-cooling performance (air volume).

Further, since the dimension and configuration of the frame 40 are designed so as to provide a space "S" having a predetermined depth between the mesh member 50 and the outer casing 20, it is now possible to increase an effective cooling air-sucking area as compared with the conventional structure where the mesh member is directly adhered onto the surface of the outer casing. Moreover, since this increment of effective cooling air-sucking area cannot be offset by the adsorption of the mesh member 50 onto the outer casing 20 that may be caused by the negative pressure resulting from the operation of the cooling fan, it is possible to secure a sufficient engine-cooling performance (air volume) even if the mesh member is partially clogged by the fibrous sawdust that has been trapped by the mesh member 50.

The securing of this space "S" is important because when the mesh member is adsorbed onto the outer casing, the refuse-trapping capacity of the mesh member deteriorates considerably. Therefore, in this embodiment, this space "S" is set so as to secure a depth of at least 2 mm or more.

Further, since the frame 40 is partially or entirely disposed on the outside (front surface side) of the mesh member 50, it is possible to reduce the possibilities of the mesh member 50 being damaged by an external factor such as the collision thereof with branches of tree.

Furthermore, when the mesh member 50 is formed integral with the frame 40, it is possible to secure a additional structural strength. Additionally, since the refuse-trapping cover is removably attached, through mounting hooks 41-44, to the outer casing 20, the removal of the refuse-trapping cover from the outer casing 20 for disuse of the refuse-trapping cover can be facilitated. Likewise, the attachment of the refuse-trapping cover to the outer casing 20 when it is needed to use can be easily performed, thus enhancing the convenience in the employment thereof.

What is claimed is:

1. A refuse-trapping cover for a portable working machine, the portable working machine including a main housing incorporating therein a cooling fan for an internal combustion engine, and an outer easing having a plurality of air inlet slits and disposed to cover the cooling fan, said refuse-trapping cover comprising:

a frame having a plurality of open windows and attached to the outer casing to thereby cover the air inlet slits, and a mesh member integrally fixed to the frame to thereby cover said plurality of open windows, wherein the frame includes a predetermined dimension and configuration and the mesh member is fixed to a predetermined location of the frame to thereby provide at least a 2 mm space between the mesh member and the outer casing to avoid the mesh member from being adsorbed onto the outer casing.

2. The refuse-trapping cover according to claim 1, wherein the frame is at least partially located outside the mesh member.

3. The refuse-trapping cover according to claim 1, wherein the frame comprises a resilient elastic synthetic resin.

4. The refuse-trapping cover according to claim 1, wherein the mesh member is attached to the frame by insert molding or integral molding, thereby rendering the mesh member sandwiched between a front surface of the frame and a rear surface of the frame.

5. The refuse-trapping cover according to claim 1, wherein the mesh member comprises a synthetic resin or a metallic material.

6. The refuse-trapping cover according to claim 1, wherein a grid portion of the mesh member includes a plurality of openings between 0.5 $mm^2$-3.0 $mm^2$ in size.

7. The refuse-trapping cover according to claim 1, wherein the refuse-trapping cover is removably attached to the outer casing.

8. The refuse-trapping cover according to claim 7, wherein the frame includes a mounting hook adapted to be engaged with a peripheral edge portion of the air inlet slits.

9. A portable working machine including a main housing incorporating therein a cooling fan for an internal combustion engine;

an outer casing having a plurality of air inlet slits and disposed to cover the cooling fan; and a refuse-trapping cover adapted to be attached to the outer casing, the refuse-trapping cover comprising:

a frame having a plurality of open windows and adapted to be attached to the outer casing to thereby cover the air inlet slits; and a mesh member integrally fixed to the frame to thereby cover said plurality of open windows, wherein the frame includes a predetermined dimension and configuration and the mesh member is fixed to a predetermined location of the frame to thereby provide at least a 2 mm space between the mesh member and the outer casing to avoid the mesh member from being adsorbed onto the outer casing.

10. The portable working machine according to claim 9, wherein the frame is at least partially located outside the mesh member.

11. The portable working machine according to claim 9, wherein the frame comprises a resilient elastic synthetic resin.

12. The portable working machine according to claim 9, wherein the mesh member is attached to the frame by insert molding or integral molding, thereby rendering the mesh member sandwiched between a front surface of the frame and a rear surface of the frame.

13. The portable working machine according to claim 9, wherein the mesh member comprises a synthetic resin or a metallic material.

14. The portable working machine according to claim 9, wherein a grid portion of the mesh member includes a plurality of openings between 0.5 $mm^2$-3.0 $mm^2$ in size.

15. The portable working machine according to claim 9, wherein the refuse-trapping cover is removably attached to the outer casing.

16. The portable working machine according to claim 15, wherein the frame includes a mounting hook adapted to be engaged with a peripheral edge portion of the air inlet slits.

* * * * *